US006634096B1

(12) United States Patent
Yamamoto et al.

(10) Patent No.: US 6,634,096 B1
(45) Date of Patent: Oct. 21, 2003

(54) TERMINAL REMOVAL JIG

(75) Inventors: Masaya Yamamoto, Shizuoka (JP); Kimihiro Abe, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 101 days.

(21) Appl. No.: 09/705,748

(22) Filed: Nov. 6, 2000

(30) Foreign Application Priority Data

Nov. 9, 1999 (JP) ..... 11-317776

(51) Int. Cl.[7] ..... H01R 43/00

(52) U.S. Cl. ..... 29/764; 29/235; 29/758; 29/426.6

(58) Field of Search ..... 29/764, 235, 278, 29/758, 270, 426.6; 294/1.1, 100; 439/747, 749

(56) References Cited

U.S. PATENT DOCUMENTS 3,168,750 A * 2/1965 Gattiker, Jr. ..... 7/14.1
3,866,294 A * 2/1975 McCaughey ..... 29/203 H
3,997,956 A * 12/1976 McKee ..... 29/203 MW
5,210,934 A * 5/1993 Lenzi et al. ..... 29/764
5,402,562 A * 4/1995 Saito et al. ..... 29/764
2002/0040520 A1 * 4/2002 Suzuki ..... 29/758

FOREIGN PATENT DOCUMENTS

JP 62-188080 11/1987

* cited by examiner

*Primary Examiner*—Carl J. Arbes
*Assistant Examiner*—Minh Trinh
(74) *Attorney, Agent, or Firm*—Armstrong, Westerman & Hattori, LLP

(57) ABSTRACT

A terminal removal jig, for removing a terminal within a connector housing, having an outer case with a guide groove, a positioning member which has a protruding portion to be engaged with a terminal insertion hole at a front end of the connector housing, an elastic body for urging the positioning member and an unlocking plate secured on the outer case and having an unlocking pin to be mated with a locking lance within the connector housing. The unlocking pin is located behind the protruding portion and is kept in contact with the outer wall of the positioning member. The protruding portion is engaged with the terminal insertion hole and the tip of the unlocking pin faces a terminal removal jig insertion hole opposite to the locking lance. A protruding strip is formed on the outer wall and a front guide hole is formed in the unlocking plate. The inner wall of the front guide hole is successive to the stem of the unlocking pin, a protrusion is formed on the positioning member, and a guide hole is formed in the unlocking plate.

7 Claims, 6 Drawing Sheets

TERMINAL REMOVAL JIG

BACKGROUND OF THE INVENTION

1. Field of the Invention

The present invention relates to a terminal removal jig for removing a terminal by warping a securing lance within a connector housing.

2. Description of the Related Art

FIG. 8 is a conventional terminal removal jig 51 disclosed in JUM-A-62-188080.

The terminal removal jig has a size approximately equal to that of a pencil, and is composed of a bar-like grip 52, an unlocking pin 53 which protrudes from the tip of the grip 52, a terminal pushing pin 54 which protrudes movably from the tip of the grip 52 and located shorter than the unlocking pin 53 and a coil spring 55 for urging the terminal pushing pin 54 in a protruding direction.

FIGS. 9A to 9C sequentially show the process for removing a terminal 57 using the terminal removal jig 51.

As seen from FIG. 9A, a terminal 57 is accommodated in a terminal accommodating chamber 59 at the rear of a connector housing 58 of synthetic resin, and a tab 60 which serves as an electrical contact of the terminal 57 protrudes into a connector fitting chamber 61 at the front of the connector housing 58. In this state, releasing of the terminal 57 is prevented in such a manner that an elastic locking piece 62 which protrudes from an intermediate portion of the terminal 57 is brought into contact with a step 64 at the end of a space 63 successive from the connector fitting chamber 61 in an axial direction.

The connector housing 58 is a female type which has the connector fitting chamber 61, whereas the terminal 57 is a male type which has the tab 60. An electric wire 66 is crimped on the end of the terminal 57. The female-type connector housing 58 and the male-type terminal 57 constitute a female-type connector 56. A male connector (not shown) is fit in the connector fitting chamber 61. The tab 60 of the male terminal 57 is inserted in and connected to an electric contact of a female terminal within the male connector. In this specification, the connector 56 having the connector fitting chamber 61 is defined as a female connector, whereas a connector (not shown) having a front end corresponding to the connector fitting chamber 61 is defined as a male connector.

In FIG. 9A, the tip of the terminal removal jig 51 is inserted into the connector filling chamber 61 until the terminal pushing pin 54 is brought into contact with the tip of the tab 60. In this state, the terminal removal jig 51 is moved forward as seen from FIGS. 9B and 9C so that the unlocking pin 53 enters the space 63 where the elastic locking piece 64 of the terminal 57 is located. When the tip of the unlocking pin 53 is brought into contact with the elastic locking piece 64, it warps the elastic locking piece 62 so that the terminal 57 is eventually unlocked.

At the stage of FIG. 9B before unlocking, the terminal pushing pin 54 moves backwards while it compresses the coil spring 55 (FIG. 8). As seen from FIG. 9C, the elastic locking piece 62, while it is warped, gets over the step 64. Simultaneously, the terminal 57 is pushed by the terminal pushing pine 54 so that it moves backwards. Finally, the electric wire 66 is pulled to draw out the terminal 57 from the terminal accommodating chamber 59. The terminal 57 may be drawn out in the cases where the terminal 57 within the connector 56 exhibits poor conduction, the terminal 57 is impaired and an alien terminal is erroneously inserted, etc.

However, the conventional terminal removal jig 51 described above has the following defects. It is difficult to align smoothly the unlocking pin 53 with the elastic securing piece 57 for securing the terminal 57 so that some experience is required to do the work of unlocking the terminal 57. Owing to unfamiliarity with dealing with the terminal releasing jig, the unlocking pin 53 may be inserted into the other portion of the connector housing 58, the unlocking pin 53 may pick at the terminal 57 so that the terminal is deformed, or the connector housing 58 maybe damaged. Further, since the locking releasing pin 53 is slender and relatively sharp in its tip, a worker may be injured from the tip of the unlocking pin 53. The terminal removal jig 51, which is dedicated to the female connector 56, cannot be applied to a male connector (not shown). Therefore, the terminal removal jig which can be applied to the male connector and permits the terminal to be unlocked easily by anyone has been eagerly demanded.

SUMMARY OF THE INVENTION

An object of the present invention is to provide a terminal removal jig which can be applied to a male connector and easily aligned when a terminal is unlocked from a connector housing so that the terminal can be unlocked simply, easily and safely by anyone.

In order to attain the above object, in accordance with the invention, there is provided a terminal removal jig comprising: an outer case having a guide groove; a positioning member having a protruding portion at its tip which is to be engaged with a terminal insertion hole at a front end of a connector housing; an elastic body for urging the positioning member toward its protruding direction; and an unlocking plate secured on the outer case and having a unlocking pin at its tip, the unlocking pin being to be mated with an elastic locking lance within the connector housing.

In this configuration, by engaging the protruding portion at the tip of the positioning member in the terminal insertion hole of the connector, the position of the unlocking pin relative to the locking lance is defined accurately. Therefore, in this state, if the outer case is moved forward, the unlocking pin moves forward integrally to it to warp the locking lance so that the terminal is surely unlocked. In this case, while the positioning member moves backward, its protruding portion is always engaged in the terminal insertion hole, the position of the unlocking pin is always defined accurately. Thus, anybody can unlock the terminal simply and surely. Particularly, it is possible to unlock the terminal for the male connector having a terminal insertion hole simply and surely. Further, since an error of inserting the unlocking pin into the terminal insertion hole does not occur, an inconvenience of damaging or deforming the terminal within the connector by the tip of the unlocking pin can be prevented.

Preferably, in a free state of the positioning member, the tip of the unlocking pin is located behind the protruding portion of the positioning member. In this configuration, the tip of the unlocking pin is aligned with the positioning member and does not protrude externally. Therefore, an accident of injuring a worker by the sharp tip of the unlocking pin or damaging the connector housing can be prevented.

Preferably, the unlocking pin is kept in contact with the outer wall of the positioning member. In this configuration, the positioning accuracy of the unlocking pin relative to the positioning member or terminal insertion hole can be enhanced.

Preferably, in a state where the protruding portion is engaged in the terminal insertion hole, the tip of the unlocking pin faces a terminal removal jig insertion hole opposite to the locking lance. In this configuration, the unlocking pin has only to be moved forward so that it is inserted into the terminal removal jig insertion hole. This warps the locking lance to unlock the terminal surely.

Preferably, a protruding strip is formed on the outer wall of the positioning member, and a slit-like guide hole in which the protruding strip is slidably engaged is formed in the unlocking plate. In this configuration, the protruding strip is slidably engaged in the guide hole so that the unlocking plate, i.e. unlocking pin can be accurately positioned with respect to the positioning member.

Preferably, the inner wall of the slit-like guide hole is successive to the stem of the unlocking pin. In this configuration, since the protruding strip is located in contact with the stem of the unlocking pin, the alignment between the protruding strip, i.e. positioning member and the unlocking pin is accurately made, and the terminal can be removed more accurately.

Preferably, a protrusion serving as a stopper is formed on the positioning member, and a lengthy guide hole in which the protrusion is slidably engaged is formed in the unlocking plate. In this configuration, when the positioning member is urged by the elastic body so that it is protruded, the protrusion is brought into contact with the front end of the guide hole. Thus, the advancing limit of the positioning member can be accurately defined and the relative position of the tip of the unlocking pin to the protrusion can be accurately defined.

The above and other objects and features of the invention will be more apparent from the following description taken in conjunction with the accompanying drawings.

DESCRIPTION OF THE PREFERRED EMBODIMENTS

Figure 1:
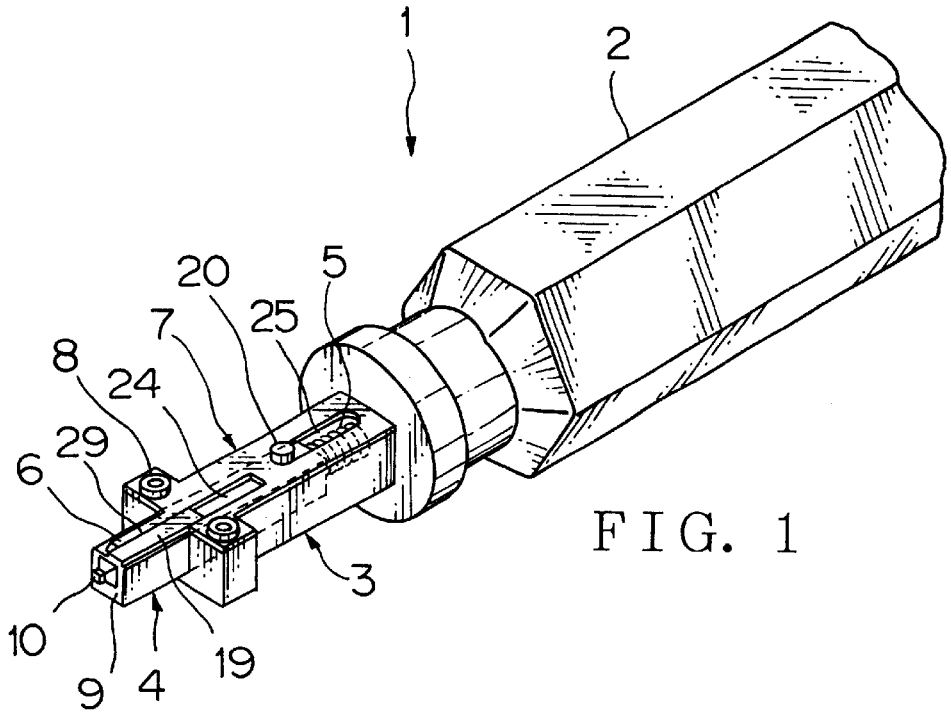
FIG. 1 is an overall perspective view of an embodiment of a terminal removal jig according to the present invention.

Now referring to the drawings, a detailed explanation will be given of embodiments of the present invention.

Figure 2:
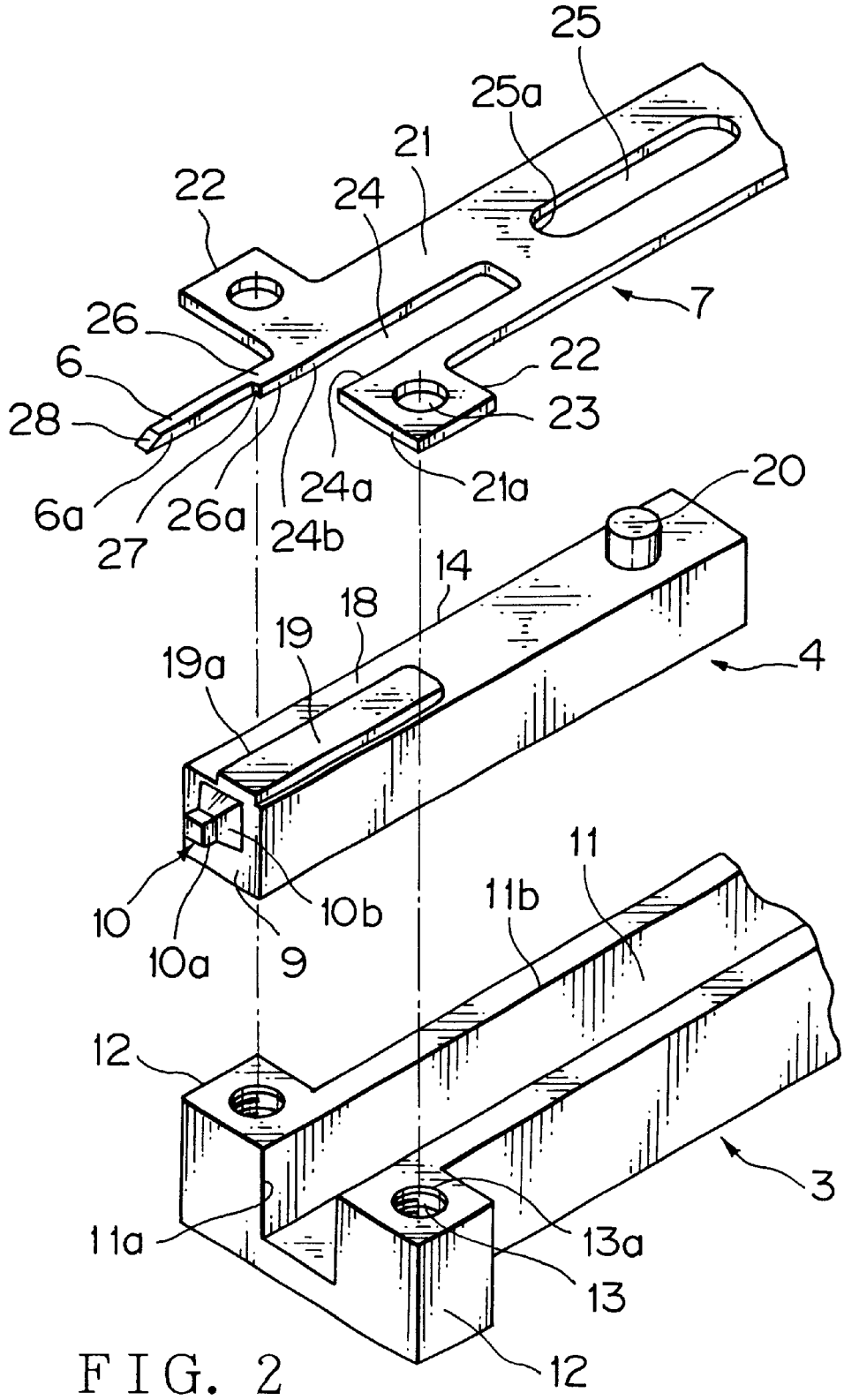
FIG. 2 is an exploded perspective view showing the main portion of the terminal removal jig.

FIGS. 1 and 2 show an embodiment of a terminal removal jig according to the present invention.

As seen from FIG. 1, a terminal removal jig 1 is composed of a grip 2 having a shape similar to that of a screwdriver, an outer case 3 which protrudes from the tip of the grip 2 and has a concave section, a positioning member 4 which is mounted slidably in a moving direction within the outer case, a coil spring (elastic member) for urging the positioning member 4 toward a protruding direction and an unlocking plate 7 which is secured to the outer case 3 and has an unlocking pin 6 at its tip.

The unlocking plate 7 is secured to the outer case 3 by small bolts 8. The positioning member 4 is urged by the coil spring 5 so that its front portion protrudes from the tip of the outer case 3. In this state, the tip of the unlocking pin 6 is located slightly behind the tip or front surface 9 of the positioning member 4. The positioning member 4 has a protruding portion 10 at its tip. The outer case 3 which is formed individually from the grip 2 is fixedly inserted into the grip 2. The grip 2, outer case 3 and positioning member 4 are made of metal or synthetic resin. The unlocking plate 7 is made of preferably metal.

As seen from FIG. 2, the outer case 3 has a guide groove 11 having a sectional square shape in a longitudinal direction. The outer case 3 has a pair of flanges 12 on both sides of its tip. Each flange 12 has a female screw hole 13 for fixing the unlocking plate 7. The guide groove 11 has openings 11*a* and 11*b* on the front side and upper side of the outer case 3, respectively. The female screw hole 13 has an opening 13*a* which is flush with the opening 11*b* on the upper side. Incidentally, in this specification, "upper" and "lower" is defined for the sake of convenience, and hence do not necessarily accord with the direction of the terminal removal jig 1 (FIG. 1) when it is used.

Figure 3:
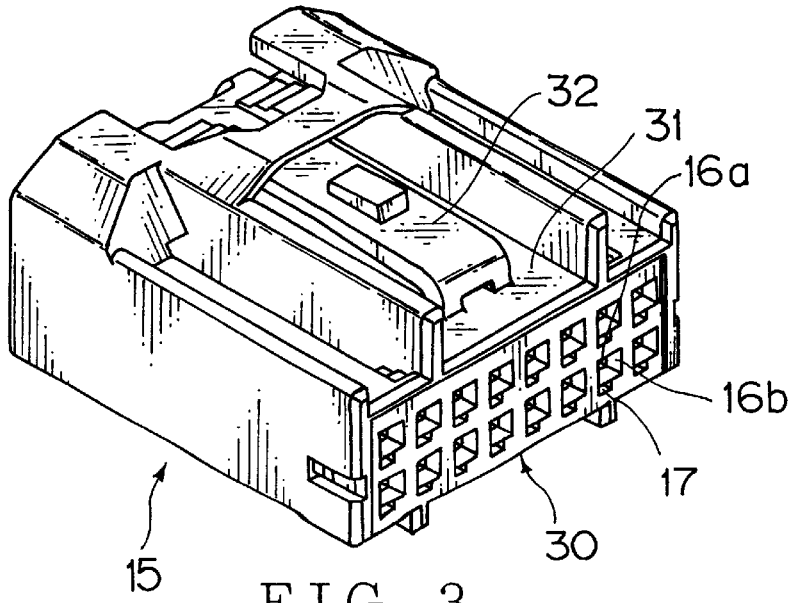
FIG. 3 is a perspective view of an embodiment of the a male connector housing.

The positioning member 4 is formed in a square bar shape. The positioning member 4 has a protruding portion 10 which is integral to the front surface 9 of its body 14 and is to be engaged with a terminal insertion hole 16 at the fitting front end of a male connector housing 15 shown in FIG. 3. The terminal insertion hole 16 is square-shaped and is composed of a straight portion 16*a* on the back side and a slanted portion 16*b* on the inlet side. The protruding portion 10 shown in FIG. 2 is composed of a cube-like front half 10*a* corresponding to the straight portion 16*a* (FIG. 3)

and a square-pyramid-like rear half 10*b* corresponding to the slanted portion 16*b* (FIG. 3). The rear half 10*b* is integrally successive from the front surface 9 of the body 14.

The protruding potion 10 is located in proximity to the upper surface of the body 14. The upper surface (outer wall) 18 is orthogonally successive to the front surface 9. A protruding strip 19 for guiding is formed integrally onto the upper surface 18 of the positioning member 4 so that it extends from the front surface 9 to the intermediate portion in the longitudinal direction. A short-cylindrical protrusion 20 serving as a stopper is also formed close to the rear end of the upper surface 18. The protruding strip 19 is located in proximity to the one side of the upper surface 18 and the protrusion 20 is located centrally on the upper surface 18 in the width direction of the positioning member 4. The protruding portion 10 is located in the vicinity of the protruding strip 19. This enhances the alignment accuracy between the unlocking pin 6 and the protruding portion 10 in FIG. 1. The body 14 is formed to have such a width that it is engaged slidably in the longitudinal direction in the guide groove 11 of the outer case 3 with no backlash and to have a slightly shorter height than the depth of the guide groove 11.

The unlocking plate 7 is composed of a rectangular plate body 21 and the unlocking pin 6 which protrudes forward from the tip of the plate body 21. On both sides of the tip of the plate body 21, a pair of flanges 22 which have the same areas as those of the flanges 12 of the outer case 3 are formed. A pair of bolt through-holes 23 are made in the flanges 22 so that they correspond to the female screw holes 13.

A slit-like front guide hole 24, which is adapted to the protruding strip 19 of the positioning member 4, is formed to extend from the front end of the plate body 21 to the intermediate portion thereof in the longitudinal direction. Behind the front guide hole 24 of the unlocking plate 7, a lengthy rear guide hole 25 is formed which is adapted to the protrusion 20 of the positioning member 4. The front guide hole 24 is located close to the one side of the plate body 21 whereas the rear guide hole 25 is centrally located in the width direction on the guide plate body 21.

The front guide hole 24 is formed to have a slightly greater width than that of the protruding strip 19 so that the protruding strip 19 is engaged slidably in the front guide hole 24 and the rear end of the protruding strip 19 can be brought into contact with the rear end of the front guide hole 24. The rear guide hole 25 is formed to have a slightly greater width than that of the protrusion 20 of the positioning member 4 so that the protrusion 20 can be engaged slidably in the rear guide hole 25 and can be brought into contact with an arc-like front end 25*a* of the rear guide hole 25 and the rear end thereof. The unlocking plate 7 has a thickness which is equal to the height of the protruding strip 19 and smaller than the height of the protrusion 20 in its axial direction.

The front guide hole 24 has inner surfaces 24*a* and 24*b* in parallel to each other on its sides. The one inner surface 24*a* is orthogonally successive to the front end 21 a of the plate body 21, whereas the other inner surface 26*b* is slightly extended forward to be successive to the inner surface 26*a* of the stem 26 of the unlocking pin 6 and further successive to the one outer surface 6*a* of the unlocking pin 6 through a step 27. The unlocking pin 6 is extended straight from the front end of the plate body 21 in such a state where it is offset from the axis center of the plate body 21 toward its outside. The unlocking pin 6 is formed to have a sectional square shape and a slanted face 28 at the tapered tip which is oriented upward.

In the assembled state of the terminal removal jig shown in FIG. 1, the rear end of the protruding strip 19 of the positioning member 4 is at the front side of the front guide hole 24 of the unlocking plate 7 so that the protruding strip 19 is positioned along the unlocking pin 6. In this case, the unlocking pin 6 is located in parallel to the protruding strip 19. The one side surface 19*a* (FIG. 2) of the protruding strip 19 is in contact with the side surface 26*a* of the stem 26 (FIG. 2) of the unlocking pin 6 and the upper surface of the body 14 (FIG. 2) is in contact with the lower surface of the unlocking pin 6. In this way, the positioning member 4 is positioned two-dimensionally accurately with respect to the unlocking pin 6. A slight gap is formed between the side surface 6*a* other than the stem 26 of the unlocking pin 6 and the side surface 19*a* of the protruding strip 19. This gap 29 serves to relax the sliding resistance of the protruding strip 19 and prevent the abrasion of the unlocking pin 6.

In the state where the tip of the unlocking pin 6 is located at the position slightly recessed from the front surface 9 of the positioning member 4, the rear protrusion 20 of the positioning member 4 is in contact with the front end of the rear guide hole 25 so that the advancing limit of the positioning member 4 is defined. When the positioning member 4 moves backward against the urging force of the spring 5, the rear end of the protruding strip 19 is brought into contact with the front guide hole 24 and the protrusion 20 is brought into contact with the rear end of the rear guide hole 25. In this way, the positioning member 4 moves backward so that the unlocking pin 6 is protruded from the front surface 9 of the positioning member 4.

FIG. 3 shows a male connector housing 15 made of synthetic resin. A separate front holder 30 made of synthetic resin is inserted into the front end of the connector housing 15. The front holder 30 has a plurality of terminal insertion holes 16 aligned to correspond to the male terminals of an opposing female connector (not shown). A terminal removal jig insertion hole 17 is formed adjacently to each of the lower sides of the terminal insertion holes. The terminal removal jig insertion hole 17 is located eccentrically toward the one side with respect to the terminal insertion hole 16. The connector housing 15 is provided with a locking arm 32 corresponding to a partner female connector housing (not shown) on its upper wall.

Figure 4:
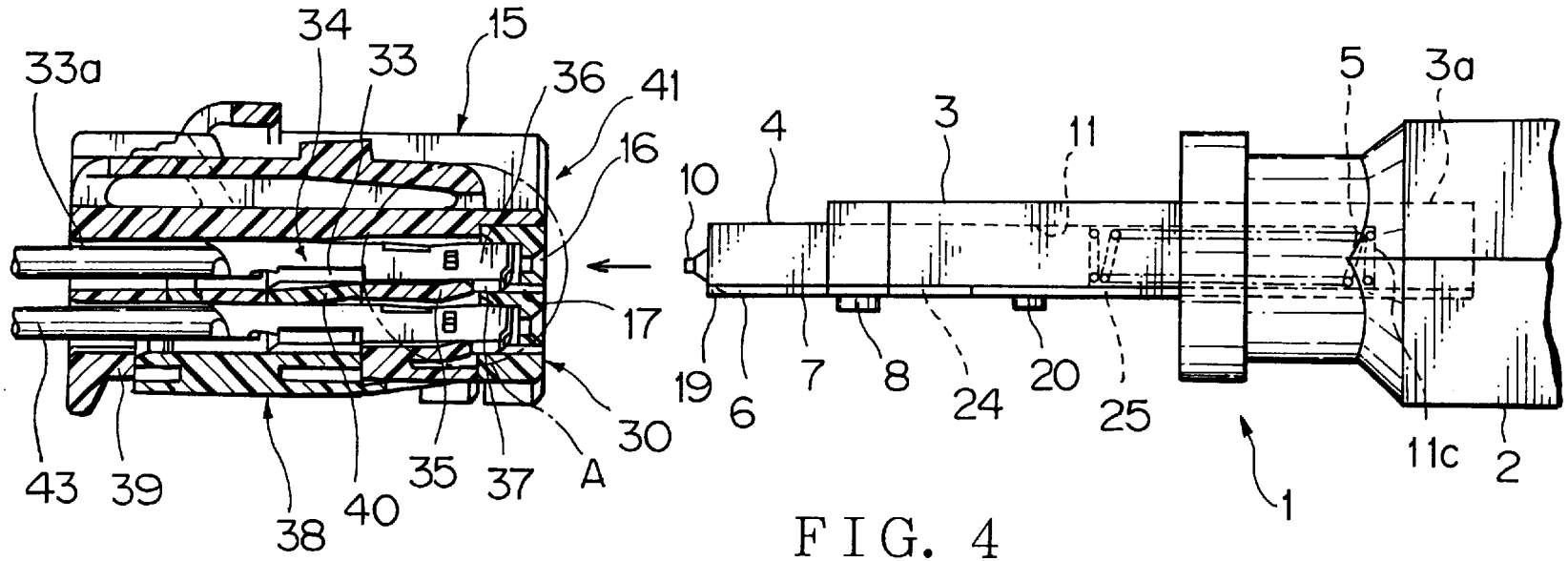
FIG. 4 shows a state where the terminal jig is applied to a male connector, in which the connector is illustrated in a longitudinal sectional view and the terminal removal jig is illustrated in a side view.

As seen from FIG. 4, each terminal insertion hole 16 is successive to the terminal accommodating chamber 33. A female terminal 34 is inserted into the terminal accommodating chamber 33. A female terminal 34 is inserted into the terminal accommodating chamber 33 from its rear opening 33*a* and once locked by an elastic locking lance 35 within the connector housing 15. The locking lance 35 abuts on the terminal accommodating chamber 33. The terminal removal jig insertion hole 17 at the front end of the connector housing is opposite to the tip of the locking lance 35.

The terminal 34 is secured by the tip of the locking lance 35 at the protrusion 37 on the lower side of the front end of a square-cylindrical electric contact 36. A spacer 38 (FIG. 4)

for secondarily securing the terminal is inserted from the opening of the lower wall 39 of the connector housing 15 and provisionally secured at the intermediate position thereof in the longitudinal direction. The terminal is inserted into the terminal accommodating chamber 33 in the state where the spacer 38 is provisionally secured. While the terminal is being inserted, the locking lance 35 warps downward. When the terminal 34 is completely inserted, the locking lance 35 is restored to lock the above protrusion 37. Subsequently, the spacer 38 is pushed upward so that the rear end of the electric contact 36 of the terminal 34 is secondarily locked by the locking step 40 at the front end of the spacer 38. The connector housing 15, the front holder 30, terminal 34 and spacer 38 constitute a male connector 41. The operation of removing the terminal 34 is made in the state where the spacer 38 is provisionally locked.

As seen from FIG. 4, the terminal removal jig 1 shown in FIG. 1 is used in such a manner that it is turned upside down for the male connector 41. When the protruding portion 10 of the positioning member 4 is located so as to oppose to the inlet of the terminal insertion hole 16, the tip of the unlocking pin 6 of the unlocking plate 7 is located oppositely to the inlet of the terminal removal jig insertion hole 17. The distance (pitch) between the protrusion 10 and the unlocking pin 6 in the vertical and horizontal direction is equal to that (pitch) between the terminal insertion hole 16 and the removal jig 17 in the vertical and horizontal direction.

The stem 3*a* of the outer case 3 is inserted in the grip 2 of the terminal removal jig 1 and secured. In addition, the coil spring 5 is elastically arranged between the rear end 11*c* of the guide groove 11 of the outer case 3 and the rear end of the positioning member 4. The remaining structure is the same as that shown in FIG. 1.

Figure 5:
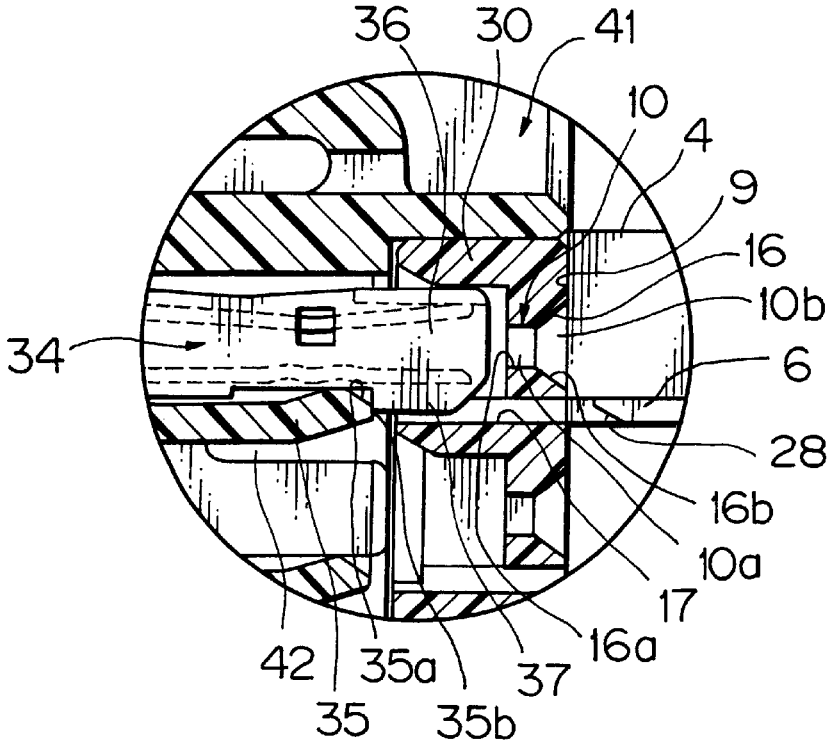
FIG. 5 is a longitudinal sectional view showing the state where a protruding portion at the tip of a terminal removal jig is engaged with a terminal insertion hole at portion "A" in FIG. 4.
Figure 6:
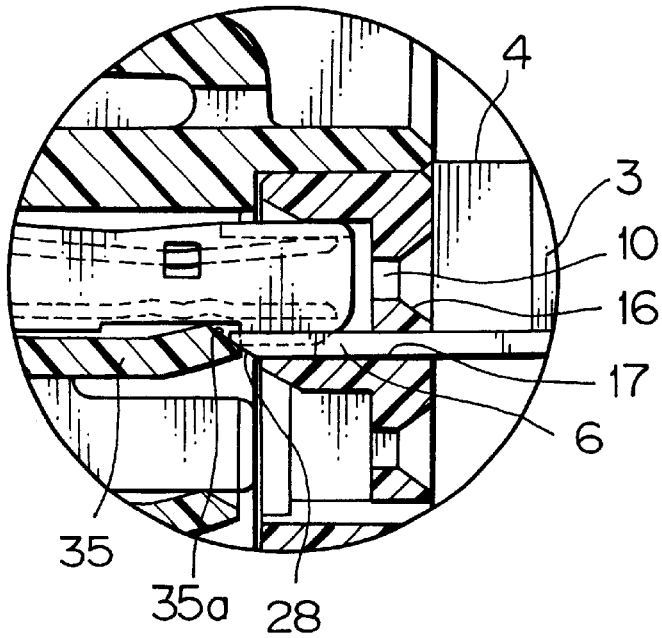
FIG. 6 is a longitudinal sectional view showing the state where the tip of an unlocking pin of a terminal removal jig is kept in contact with a locking lance.
Figure 7:
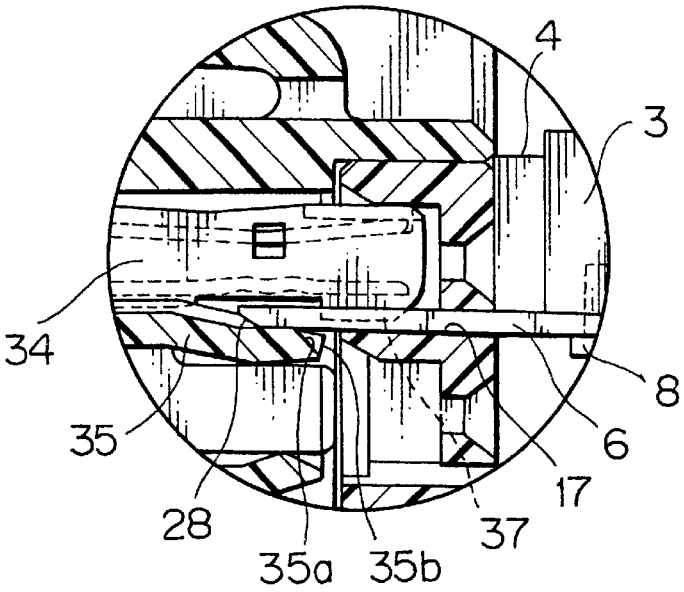
FIG. 7 is a longitudinal sectional view showing the state where the locking lance is warped by the unlocking pin to unlock the terminal.
Figure 8:
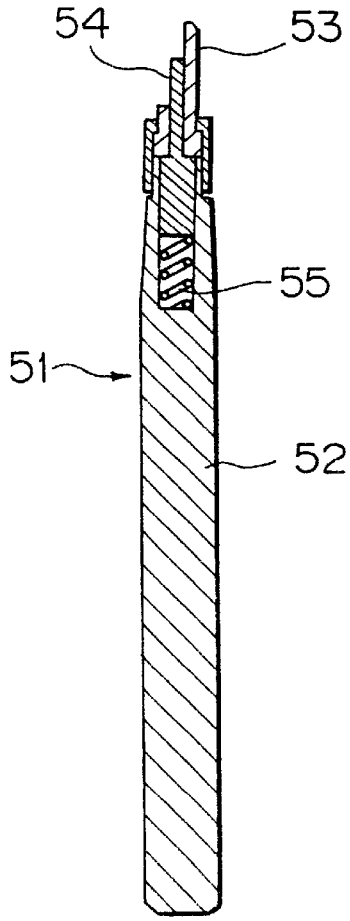
FIG. 8 PRIOR ART
FIG. 8 is a longitudinal sectional view showing an example of a conventional terminal removal jig.
Figure 9A:
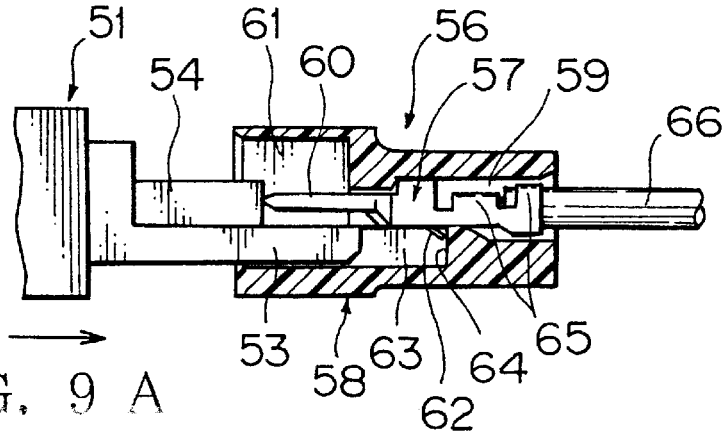
FIG. 9 A PRIOR ART
FIGS. 9A to 9C are longitudinal sectional views showing the process of unlocking a terminal using a conventional terminal jig.
Figure 9B:
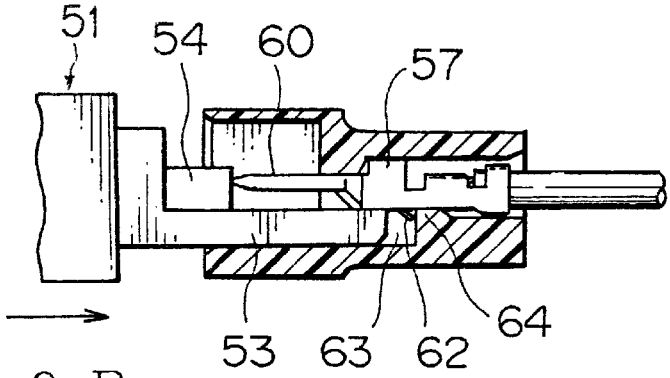
FIG. 9 B PRIOR ART
Figure 9C:
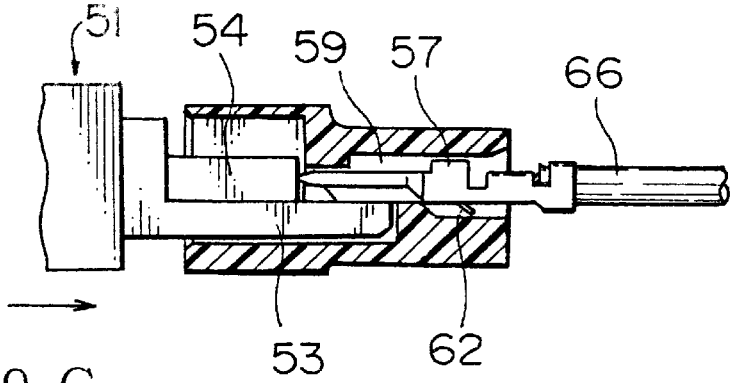
FIG. 9 C PRIOR ART

With reference to FIGS. 5–7, an explanation will be given of the method of using the terminal removal jig 1. First, the protruding portion at the tip of the positioning member 4 is engaged in the terminal insertion hole 16 at the front end of the connector 41. The cube-shaped front half 10*a* of the protruding portion 10 advances into the straight portion 16*a* at the back of the terminal insertion hole 16. The pyramid rear half 10*b* of the protrusion 10 advances to the slanted portion 16*b* at the inlet of the terminal insertion hole 16. Thus, the positioning member 4 is prevented from being rotated in a peripheral direction and being moved in an axial direction. As a result, since the positioning member 4 is positioned three-dimensionally, the position of the unlocking pin 6 relative to the terminal removal jig insertion hole 17 is specified accurately.

The front surface 9 of the positioning member 4 is brought into contact with the front surface of the front holder 30. The tip of the unlocking pin 6 is slightly spaced behind the front surface of the front holder 30. The slanted face 28 at the tip of the unlocking pin 6 is slanted in the same direction and at substantially the same angle as the slanted face 35a at the tip of the locking lance 35 so that both slanted faces are opposite in parallel to each other.

In FIG. 5, the terminal 34 is locked by the locking lance 35 in such a manner that the tip surface 35*b* of the locking lance 35 is in contact with the rear end of the protrusion 37 of the front end of the electric contact 36. The slanted face 35*a* behind the tip surface 35*b* is caused to be opposite to the outlet of the terminal removal jig. A warping space 42 is formed below the locking lance 35.

In operation, when the grip 2 of the terminal removal jig 1 (FIG. 4) is pushed forward from the state shown in FIG. 2, as seen from FIG. 6, the unlocking pin 6 moves forward to pass through the terminal removal jig insertion hole 17 so that the slanted face 28 at the tip of the unlocking pin 6 is brought into contact with the slanted face 35*a* at the tip of the locking lance 35. As the grip 2 (FIG. 4) is pushed forward, with the protrusion 10 engaged with the terminal insertion hole 16, the the positioning member 4 is slid rearward along the guide groove 11 of the outer case 3 (FIG. 4). Accordingly, the most part of the positioning member 4 is accommodated in the guide groove 11. The coil spring 5 (FIG. 4) within the guide groove 11 is pushed and compressed by the positioning member 4. In this case, the protruding portion 10 is firmly engaged in the terminal insertion hole 16 by the urging force of the coil spring 5 with no deviation in position.

When the grip (FIG. 4) is further pushed forward from the state of FIG. 6, the slanted face 28 at the tip of the unlocking pin 6 is brought into slidable contact with the slanted face 35*a* so that the locking lance 35 is warped downward. Thus, the engagement between the tip surface 35*b* of the locking lance 35 and the protrusion 37 of the terminal 34 is released. From this state, the electric wire (FIG. 4) is pulled rearward so that the terminal 34 is easily removed or pulled out.

While the terminal 34 is pulled out, the terminal removal jig 1 is pulled rearward so that the unlocking pin 6 is pulled out from the terminal removal jig insertion hole 17. In this case, since the coil spring 5 has been compressed (FIG. 4), the backward movement of the grip 2 (FIG. 4), i.e. the pulling out of the unlocking pin 6 can be easily carried out owing to the restoring force of the coil spring 5 by small force.

Incidentally, where the pitch between the terminal insertion hole 16 and the terminal removal jig insertion hole 17 is short, the positioning member 4 may be made slender enough to constitute the tip of the positioning member 4 by the protrusion for engagement. Thus, the front end surface of the body 14 of the positioning member 4 can be removed. An elastic body such as a wavy spring, rubber or sponge (not shown) can be used instead of the coil spring 5 (FIG. 4). Further, without providing the front holder, 30 (FIG. 3), the terminal insertion hole 16 or removal jig insertion hole 17 can be provided on the front end surface integral to the connector housing 15.

What is claimed is:

1. A terminal removal jig for removing a terminal from a connector housing, comprising:

an outer case having a guide groove;

a positioning member having a protruding portion at a tip of said positioning member, for engaging a terminal insertion hole at a front end of a connector housing;

an elastic body for urging the positioning member toward the direction of the protruding portion; and an unlocking plate secured on the outer case and having an unlocking pin extending from a tip of said unlocking plate, said unlocking pin adapted to be mated with a connector housing elastic locking lance within the connector housing.

2. The terminal removal jig according to claim 1, wherein in a free state of said positioning member, the tip of the unlocking pin extends in the direction of the protruding portion to a point short of the protruding portion of said positioning member.

3. The terminal removal jig according to claim 1, wherein said unlocking pin is kept in contact with an outer wall of the positioning member.

4. The terminal removal jig according to claim 1, wherein in a state where the protruding portion is engaged in the terminal insertion hole, the tip of the unlocking pin faces a terminal removal jig insertion hole opposite to the locking lance.

5. A terminal removal jig for removing a terminal from a connector housing, comprising:

an outer case having a guide groove;

a positioning member having a protruding portion at a tip of said positioning member, for engaging a terminal insertion hole at a front end of a connector housing;

an elastic body for urging the positioning member toward the direction of the protruding portion; and an unlocking plate secured on the outer case and having an unlocking pin at a tip of said unlocking plate, said unlocking pin adapted to be mated with a connector housing elastic locking lance within the connector housing, wherein a protruding strip is formed on an outer wall of said positioning member and a slit-like guide hole in which said protruding strip is slideably engaged is formed in the unlocking plate.

6. The terminal removal jig according to claim 5, wherein the inner wall of the slit-like guide hole is successive to the stem of the unlocking pin.

7. A terminal removal jig for removing a terminal from a connector housing, comprising:

an outer case having a guide groove;

a positioning member having a protruding portion at a tip of said positioning member, for engaging a terminal insertion hole at a front end of a connector housing;

an elastic body for urging the positioning member toward the direction of the protruding portion; and an unlocking plate secured on the outer case and having an unlocking pin at a tip of said unlocking plate, said unlocking pin adapted to be mated with a connector housing elastic locking lance within the connector housing, wherein a protrusion serving as a stopper is formed on the positioning member at a surface facing said unlocking plate, and a lengthy guide hole in which the protrusion is slidably engaged is formed in the unlocking plate.

* * * * *